US006936757B2

(12) United States Patent
Muramatsu et al.

(10) Patent No.: US 6,936,757 B2
(45) Date of Patent: Aug. 30, 2005

(54) PERFORMANCE APPARATUS

(75) Inventors: Shigeru Muramatsu, Mori-machi (JP); Yasutoshi Kaneko, Hamamatsu (JP)

(73) Assignee: Yamaha Corporation (JP)

( * ) Notice: Subject to any disclaimer, the term of this patent is extended or adjusted under 35 U.S.C. 154(b) by 100 days.

(21) Appl. No.: 10/625,564

(22) Filed: Jul. 24, 2003

(65) Prior Publication Data

US 2004/0123718 A1 Jul. 1, 2004

(30) Foreign Application Priority Data

Jul. 25, 2002 (JP) ..... 2002-216490

(51) Int. Cl.[7] ..... G10F 1/06

(52) U.S. Cl. ..... 84/94.1; 84/94.2; 84/95.2; 84/97; 84/98

(58) Field of Search ..... 84/94.1, 94.2, 84/95.2, 97, 98

(56) References Cited

U.S. PATENT DOCUMENTS 527,811 A * 10/1894 Richter ..... 84/98
560,936 A * 5/1896 Rodeck ..... 84/98
5,973,240 A * 10/1999 Isaka ..... 84/97

* cited by examiner

*Primary Examiner*—Shih-Yung Hsieh
(74) *Attorney, Agent, or Firm*—Dickstein, Shapiro, Morin & Oshinsky, LLP.

(57) ABSTRACT

There is provided a performance apparatus that is capable of reducing mechanical noise by a simple construction. Rotary picks are disposed in the vicinity of and in association with respective ends of a plurality of reeds, and four driving nails are formed integrally with outer peripheries of the rotary picks. A hook part is attached to the top of a plunger, and they make reciprocating motions together. The rotary pick is rotated by a driving force applied to the driving nail thereof from an engaging part formed by a lower end of the corresponding hook part. When the driving nail located symmetrically to the driving nail having received the driving force plucks the corresponding reed, the reed is sounded. The hook part is almost completely covered with a cushioning member formed of an elastic material such as rubber to absorb an impact that may occur when the driving nail of the rotary pick comes into contact with the hook part.

10 Claims, 9 Drawing Sheets

PERFORMANCE APPARATUS

BACKGROUND OF THE INVENTION

1. Field of the Invention

The present invention relates to a performance apparatus that causes sounding elements such as reeds to generate sound by means of a solenoid coil or the like.

2. Description of the Related Art

A performance apparatus such as a music box type has hitherto been known which causes sounding elements such as reeds to generate sound by means of a driving device such as a solenoid coil, which acts upon or plucks the sounding elements, without using a barrel drum.

For example, a performance apparatus of this type has been proposed by the assignee of the present application (Japanese Patent Application No. 2002-079132). This performance apparatus is comprised of a rotating member, which serves as a sounding element driving member and is provided with a plurality of driving nails on its outer periphery, and a swing arm, which serves as an actuator and is provided with a flat coil. The flat coil is disposed in a magnetic field that is generated. When the flat coil is energized, the swing arm is rotated. When a free end of the swing arm drives part of the driving nails of the rotating member to thus rotate the rotating member, the other driving nails are caused to pluck reeds to generate sound.

Further, another performance apparatus of this type has been proposed by the assignee of the present application, according to which part of driving nails of a rotating member as a sounding element driving member is engaged with and driven by a groove formed in a plunger as an actuator, which is driven to make reciprocating motions by a solenoid coil, to thereby pluck reeds in the same manner as in the first-mentioned performance apparatus. Alternatively, the solenoid coil may be used to reciprocate the plunger without using the rotating member, thus causing a driving part fixedly provided on the plunger to directly pluck the reeds.

It is very important for a performance apparatus such as a music box to suppress mechanical noise so as to generate clear and pure sound.

However, the above described performance apparatuses cause a plurality of component elements to generate sound in cooperation with each other, and is thus encountered with the problem that mechanical noises are generated at many parts due to engagement or contact between the component elements.

For example, a mechanical noise is generated due to an impact caused by engagement or contact between the sounding element driving member such as the rotating member and the actuator. Further, if it is configured such that a reciprocating member such as the swing arm or the plunger comes into contact with a stopper to define the end of the operating stroke of the reciprocating member, a mechanical noise which is not negligible is generated due to the contact between the reciprocating member and the stopper. Further, if the next sounding operation is performed before vibrations of sounding elements such as reeds caused by the previous sounding operation are not completely damped, a mechanical noise can be generated due to chattering between a driving part and sounding elements.

SUMMARY OF THE INVENTION

It is an object of the present invention to provide a performance apparatus that is capable of reducing mechanical noise by a simple construction.

To attain the above object, in a first aspect of the present invention, there is provided a performance apparatus comprising a plurality of sounding elements capable of generating sound, at least one sounding element driving member, at least one sounding element driving part provided on the sounding element driving member, for performing a sounding operation of coming into contact with any of the sounding elements to cause the sounding element to generate sound, an actuator engageable with the sounding element driving member, for driving the sounding element driving member and at least first cushioning member provided on at least one of the actuator and the sounding element driving member, for absorbing an impact occurring when the actuator comes into engagement with the sounding element driving member.

According to the first aspect of the present invention, the first cushioning member absorbs an impact which occurs when the actuator is brought into engagement with the sounding element driving member. As a result, it is possible to reduce mechanical noise by a simple construction.

Preferably, the performance apparatus according to the present invention further comprises at least one second cushioning member provided in proximity to the sounding element driving part of the sounding element driving member and wherein the second cushioning member is disposed to come into contact with any of the sounding elements immediately before the sounding element driving part comes into contact with the sounding element, for forcibly damping residual vibrations of the sounding element and the second cushioning member is further disposed to come into contact with the actuator when the actuator is engaged with the sounding element driving member, for absorbing an impact caused by engagement between the actuator and the sounding element driving member.

Preferably, the actuator is capable of making a reciprocating motion, for driving the sounding element driving member during a forward stroke of the reciprocating motion and the performance apparatus further comprises at least one upper limit stopper and at least one lower limit stopper that are disposed to come into contact with the actuator to determine an upper limit position and a lower limit position, respectively, of the actuator, the upper limit stopper and the lower limit stopper comprising at least one third cushioning member and at least one fourth cushioning member, respectively, for absorbing an impact occurring when the upper limit stopper and the lower limit stopper come into contact with the actuator.

Preferably, the sounding element driving member is capable of being rotatively driven, the sounding element driving part of the sounding element driving member being provided on the sounding element driving member in proximity to an outer periphery thereof.

More preferably, the actuator is capable of making a reciprocating motion, for engagement with the sounding element driving member during a forward stroke of the reciprocating motion to thereby rotate the sounding element driving member in a predetermined direction, the performance apparatus further comprises at least one cam mechanism comprising at least one cam part having a plurality of cam surfaces and fixedly provided on the sounding element driving member, and at least one urging member that constantly urges the cam part, the cam mechanism being disposed such that the urging member departs from and comes into contact with the cam surfaces of the cam part in response to rotation of the sounding element driving member, for applying a bias force to the sounding element driving member only in the predetermined direction immediately after a sounding operation, and the performance apparatus further comprises at least one fifth cushioning member provided on at least one of the urging member and the cam surfaces of the cam part of the cam mechanism, for absorbing an impact occurring when the urging member and each of the cam surfaces of the cam part come into contact with each other.

Still preferably, the performance apparatus further comprises at least one second braking member provided in proximity to the sounding element driving member, the second braking member being engageable with the sounding element driving member at least before the urging member and each of the cam surfaces of the cam part of the cam mechanism come into contact with each other, for decreasing a speed of the sounding element driving member when the urging member and the cam surface of the cam part come into contact with each other.

To attain the above object, in a second aspect of the present invention, there is provided a performance apparatus comprising a plurality of sounding elements capable of generating sound, at least one sounding element driving member, at least one sounding element driving part provided on the sounding element driving member, for performing a sounding operation of coming into contact with any of the sounding elements to cause the sounding element to generate sound, an actuator engageable with the sounding element driving member, for driving the sounding element driving member, a base part and at least one first braking member fixedly provided on the base part in proximity to the sounding element driving member, the first braking member being engageable with the sounding element driving member, for suppressing a motion of the sounding element driving member.

According to the second aspect of the present invention, by providing the braking member in the proper location, the moving speed of the sounding element driving member can be decreased as desired. For example, by providing the braking member at such a location that the speed of the sounding element driving member is reduced immediately before the sounding element driving member and the actuator are brought into engagement with each other, an impact occurring upon the engagement can be weakened to reduce a mechanical noise generated due to the engagement. As a result, it is possible to reduce mechanical noise by a simple construction.

Preferably, the first braking member is disposed to engage with the sounding element driving member at least before the actuator and the sounding element driving member come into engagement with each other, for decreasing a speed of the sounding element driving member when the actuator and the sounding element driving member come into engagement with each other.

The above and other objects, features, and advantages of the invention will become more apparent from the following detailed description taken in conjunction with the accompanying drawings.

BRIEF DESCRIPTION OF THE DRAWINGS

FIGS. 6A to 6I are view showing successive changes in motion of the essential parts of the actuator, in which:

FIG. 6A is a view showing initial positions of the essential parts of the actuator;

FIGS. 6B to 6H are views showing a plunger and a hook part during their reciprocating motions; and FIG. 6I is a view showing a state in which the plunger and the hook part have returned to their initial positions;

DETAILED DESCRIPTION OF THE PREFERRED EMBODIMENTS

The present invention will now be described in detail with reference to the accompanying drawings showing preferred embodiments thereof.

Figure 1:
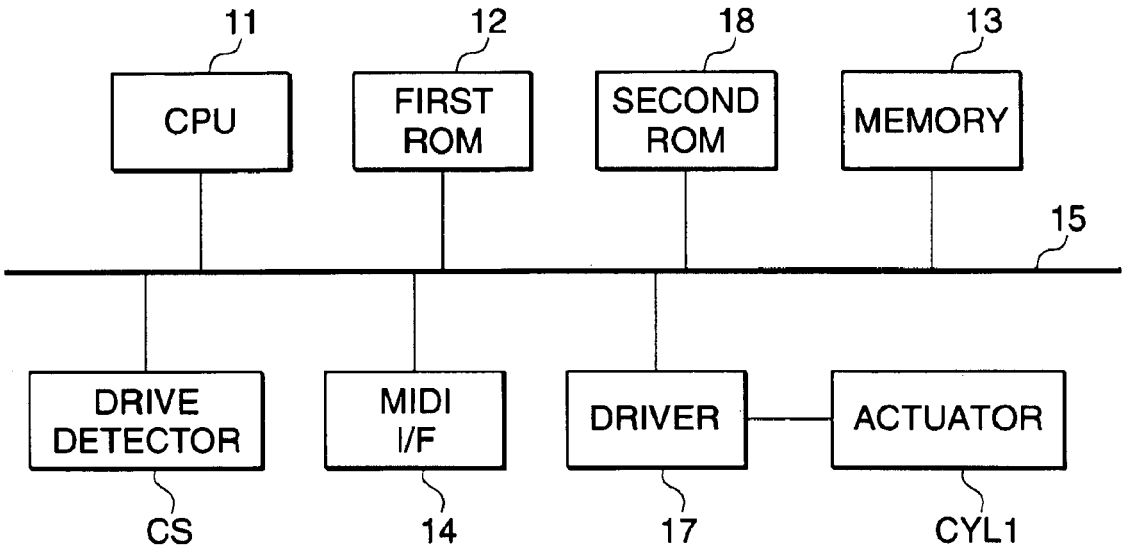
FIG. 1 is a block diagram showing the construction of a control section of a performance apparatus according to a first embodiment of the present invention.

FIG. 1 is a block diagram showing the construction of a control section of a performance apparatus according to a first embodiment of the present invention.

The performance apparatus according to the present embodiment is comprised of a first ROM 12, a memory 13, a MIDI interface (MIDI I/F) 14, a second ROM 18, drive detectors CS, and a driver 17, and a CPU 11 to which the above-mentioned component parts are connected via a bus 15. The CPU 11 controls overall operations of the performance apparatus. The first ROM 12 is comprised of a program ROM, a data ROM, and a working ROM, none of which are shown, and stores control programs to be executed by the CPU 11, various data, and so forth. The MIDI I/F 14 receives performance data inputted from MIDI equipment, not shown, or the like as MIDI (Musical Instrument Digital Interface) signals. The memory 13 is comprised of a RAM or the like, and stores various data such as performance data and can store performance data inputted from the MIDI I/F 14. The second ROM 18 stores parameter tables and the like. The driver 17 drivingly controls actuators CYL1, described later.

Figure 2:
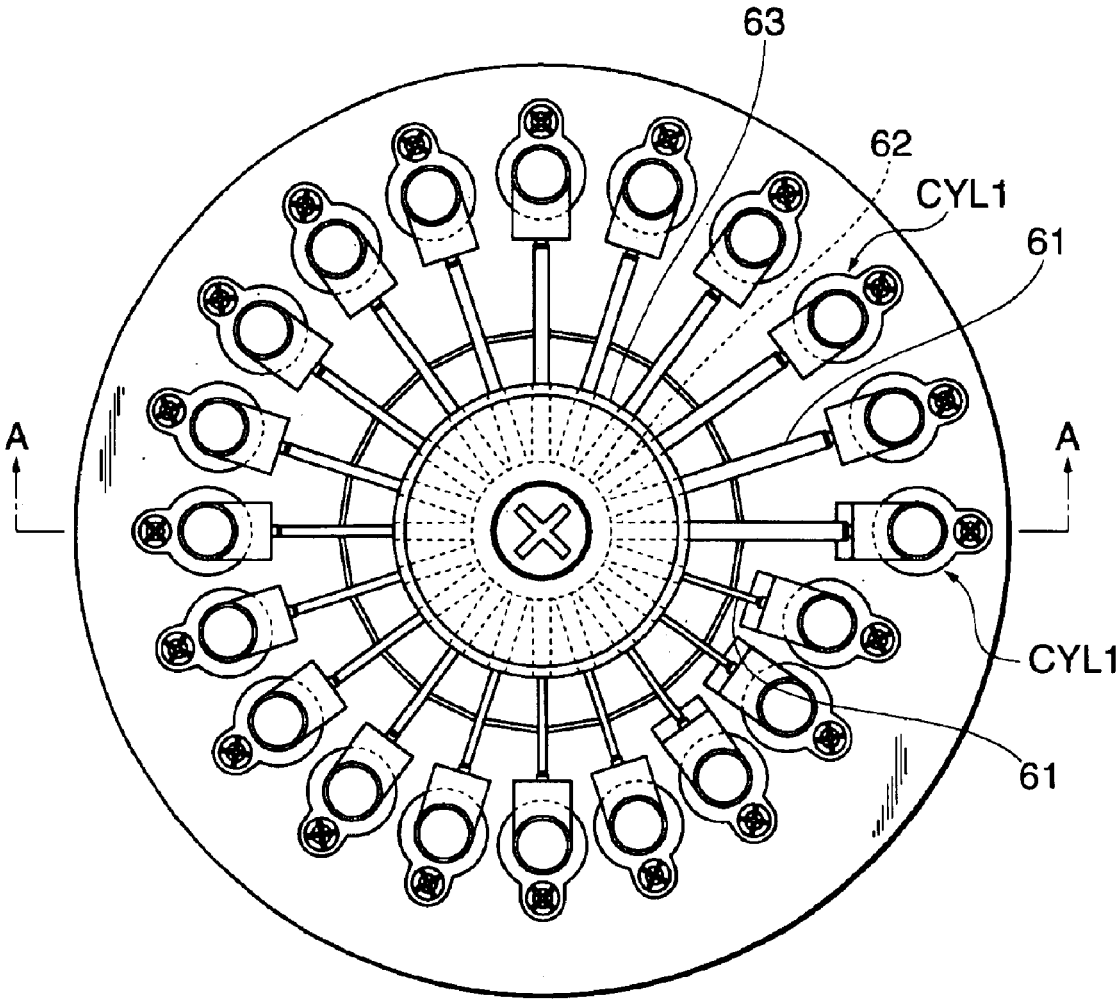
FIG. 2 is a top plan view showing the performance apparatus according to the first embodiment.
Figure 3:
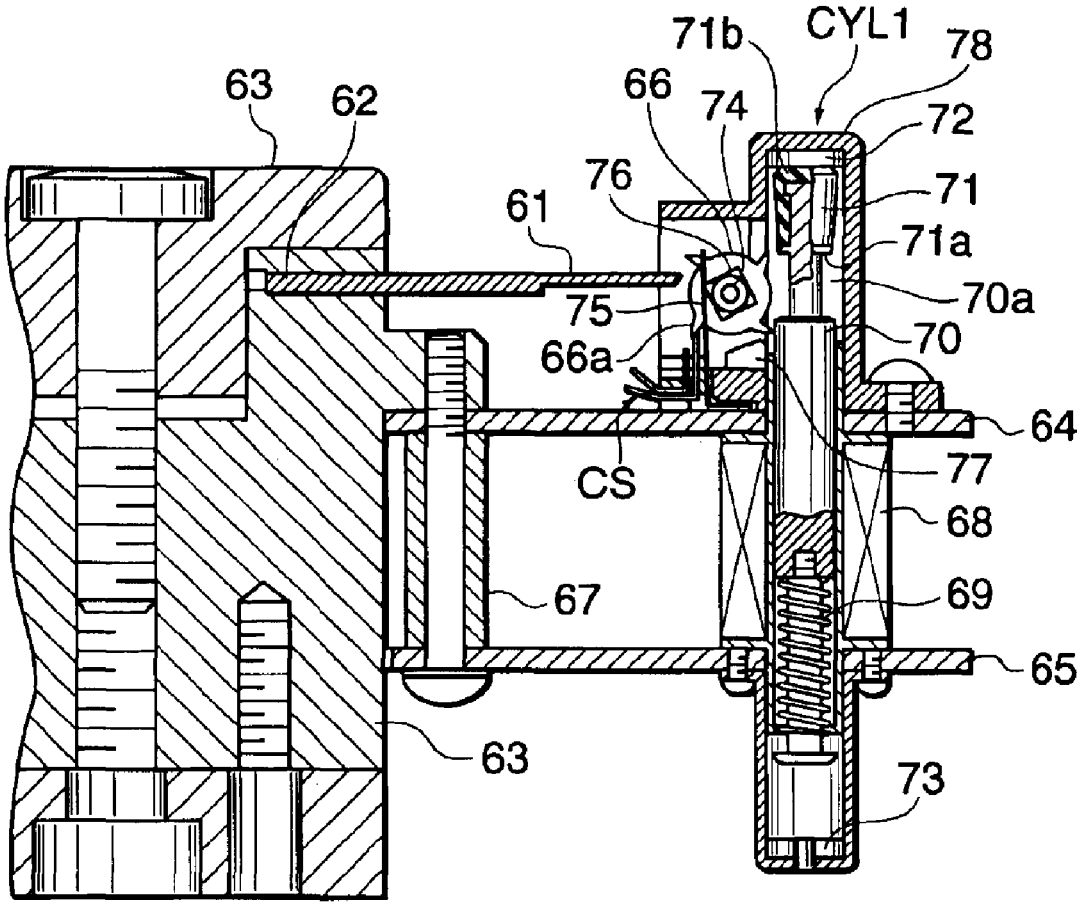
FIG. 3 is a sectional view taken along line A—A in FIG. 2.
Figure 4A:
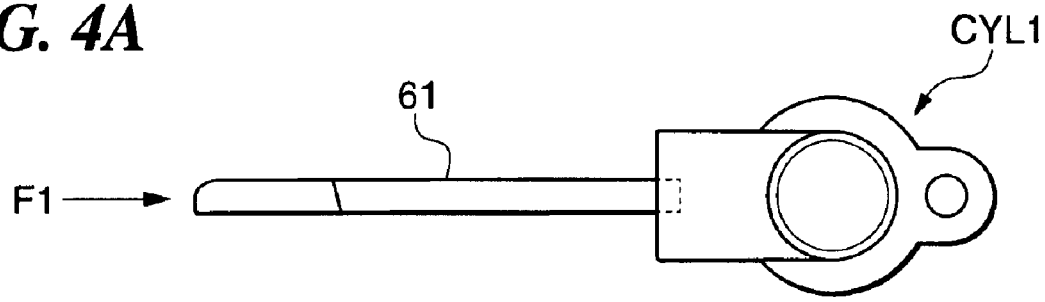
FIG. 4A is a top plan view of an actuator.
Figure 4B:
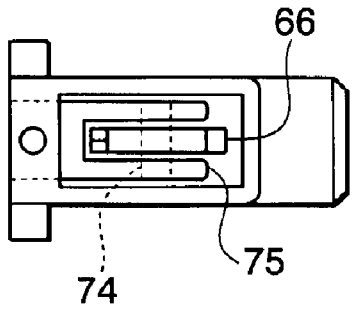
FIG. 4B is a view of the actuator in FIG. 4A as viewed from an arrow F1 in FIG. 4A.

FIG. 2 is a top plan view of the performance apparatus according to the present embodiment. FIG. 3 is a sectional view taken along line A—A in FIG. 2. FIG. 4A is a top plan view of the actuator CYL1. FIG. 4B is a view of the actuator CYL1 as viewed from an arrow F1 in FIG. 4A.

Figure 4C:
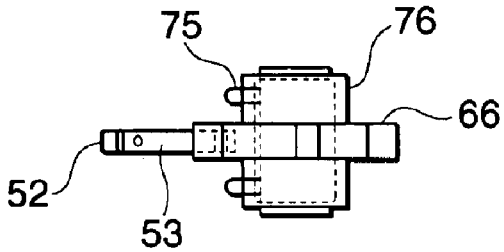
FIG. 4C is a top plan view showing a rotary pick and component parts in the vicinity thereof.

FIG. 4C is a top plan view of a rotary pick 66 (sounding element driving member) and component parts in the vicinity thereof.

Figure 5A:
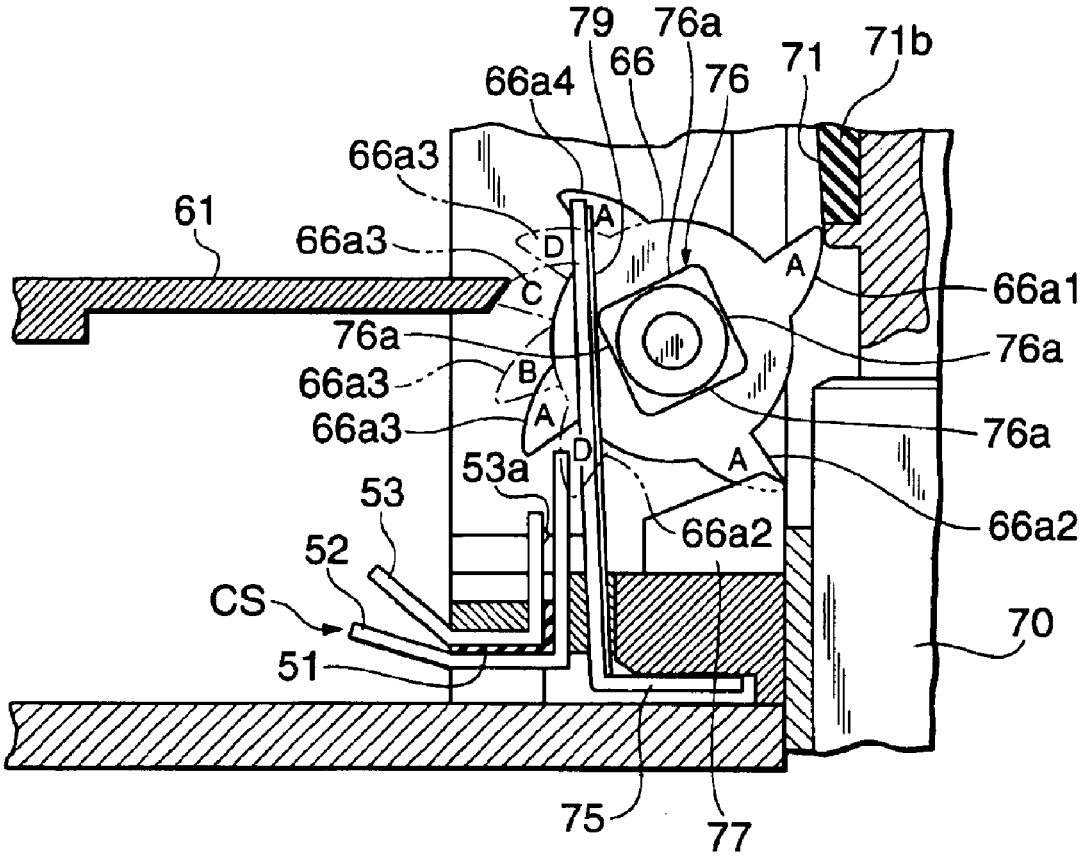
FIG. 5A is an enlarged view showing essential parts of the actuator, and more particularly, the rotary pick and component parts in the vicinity thereof.
Figure 5B:
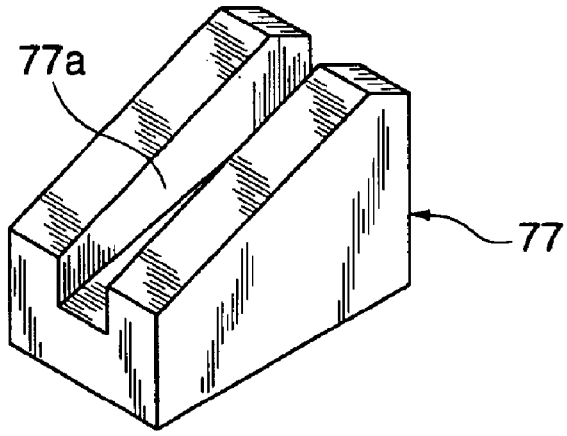
FIG. 5B is a perspective view showing the appearance of a grooved braking member.

FIG. 5A is an enlarged view showing essential parts of the actuator CYL1, and more particularly, the rotary pick 66 and component parts in the vicinity thereof. FIG. 5B is a perspective view showing the appearance of a grooved braking member 77.

The present apparatus is constructed as, for example, a music box, and is configured to electrically drivingly control the actuators CYL1 to act on reeds 61 as sounding elements, described later, so as to individually pluck them to cause them to generate sound (this will hereinafter be referred to as "pluck" or "plucking").

As shown in FIGS. 2 and 3, each of a plurality of (e.g. 20) reeds 61 has a base end part 62 thereof fixed to a center block 63, and extends radially outward from the base end 62 on a plane.

A plurality of actuators CYL1 are provided in association with the respective reeds 61. As shown in FIG. 3, each actuator CYL1 is comprised of a solenoid coil 68, a plunger 70, a plunger spring 69, a hook part 71, an upper yoke 64, a lower yoke 65, and others. The upper yoke 64 and the lower yoke 65 are shared by all the actuators CYL1 to simplify the construction. Specifically, the upper yoke 64 and the lower yoke 65 are each shaped in the form of a disk, and attached to the center block 63 almost in parallel with each other with a proper distance maintained therebetween by a yoke spacer 67.

The solenoid coil 68 is disposed between the upper yoke 64 and the lower yoke 65. The plunger 70 is disposed inside the solenoid coil 68 to make reciprocating motions in the vertical direction. The plunger spring 69 is attached to a lower end of the plunger 70 to permanently apply an upward bias force to the plunger 70. When a driving current is supplied to the solenoid coil 68, a magnetic force is generated to move the plunger 70 downward against the bias force of the plunger spring 69. When the driving current is cut off, the plunger 70 moves upward and returns to an original initial position by the bias force of the plunger spring 69.

On top of the plunger 70, the hook part 71 is mounted so as to define a channel-shaped stepped space 70*a* between the hook part 71 and the plunger 70. A lower end of the hook part 71 facing the channel-shaped stepped space 70*a* serves as an engaging part 71*a*, described hereinafter. Almost the entire surface of the hook part 71 is covered with a cushioning member 71*b* formed of an elastic material such as rubber, and the cushioning member 71*b* absorbs shock generated upon the hook part 71 being brought into contact with the rotary pick 66, as described later. Further, the hook part 71 is tapered such that the diameter thereof is increased in a direction upward as viewed in FIG. 3 so that the hook part 71 and the rotary pick 66 can slide smoothly in contact with each other when the plunger 70 moves upward.

A cylinder 78 in which the plunger 70 is fitted has an upper end and a lower end in which an upper cushion part 72 and a lower cushion part 73, each of which is formed of elastic material such rubber, are respectively provided. The reciprocating hook part 71 and plunger 70 are brought into contact with the upper cushion part 72 and the lower cushion part 73 to define their upper and lower limit positions. The upper cushion part 72 and the lower cushion part 73 function as cushioning members to absorb shock generated upon contact with the hook part 71 and the plunger 70.

The rotary pick 66 is provided for each reed 61 and disposed in the vicinity of a radially outer end of the reed 61. The rotary pick 66 has an outer peripheral surface thereof formed integrally with a plurality of (e.g. four) driving nails 66*a* (66*a*1 to 66*a*4 in FIG. 5A).

Rectangular cam parts 76 are fixedly mounted on opposite end faces of the rotary pick 66, and a cam spring 75 is disposed in the vicinity of the rotary pick 66. Each of the cam parts 76 has four cam surfaces 76*a* which are substantially flat (refer to FIG. 5A). The driving nails 66*a* receive a driving force from the engaging part 71*a* of the channel-shaped stepped space 70*a*, whereby the rotary pick 66 rotates about a rotary shaft 74. The plunger 70 and the hook part 71 constitute an "actuator" that drives the driving nails 66*a* of the rotary pick 66. As described later, the cam parts 76 and the cam spring 75 constitute a cam mechanism to rotate the rotary pick 66 substantially only in one direction (clockwise as viewed in FIG. 3) (in a predetermined direction).

The cam spring 75 is formed of an elastic sheet material such as a metal sheet and is U-shaped as shown in FIG. 4B. The cam spring 75 has one end thereof secured to the center block 63, and has two separated portions from an intermediate part to the other end, such that the two separated portions sandwich the rotary pick 66 therebetween to permanently apply a bias force to the cam part 76 in a direction away from the reed 61. Each cam part 76 has four corners thereof rounded off in a substantially arcuate shape.

Further, as shown in FIG. 5A, an elastic sheet 79 is bonded to a side of a standing part of the cam spring 75, which faces the cam part 76. The elastic sheet 79 serves as a cushioning member that comes into contact with the cam part 76 to weaken a shock occurring upon contact with each cam surface 76*a* of the cam part 76 when the cam spring 75 urges the cam part 76.

Further, as shown in FIG. 5A, below the rotary pick 66, the grooved braking member 77 is fixedly provided on the center block 63. The grooved braking member 77 is disposed in association with each rotary pick 66. The grooved braking member 77 is formed of elastic material such as rubber, and is formed therein with a groove 77*a*, as shown in FIG. 5B. The groove 77*a* extends substantially parallel with the direction diametric of the rotary pick 66, and the width of the groove 77*a* is set to be slightly smaller than that of the driving nail 66*a* of the rotary pick 66. When the rotary pick 66 rotates, the grooved braking member 77 acts to properly brake the rotation of the rotary pick 66 in such a manner that the driving nail 66*a* is engaged with the groove 77*a* by the rotation of the rotary pick 66 to slide in the groove 77*a*.

Further, each of the drive detectors CS is provided in the vicinity of the rotary pick 66. The drive detector CS is provided for the corresponding reed 61 and disposed below the radially outer end of the reed 61. The configuration of the drive detector CS will be described later.

FIG. 6 is a view showing successive changes in motion of essential parts of the actuator CYL1. The actuator CYL1 is drivingly controlled by pulse width modulation (PWM), for example, to cause a reciprocating motion of the plunger 70, but the present invention is not limited to this.

Figure 6A:
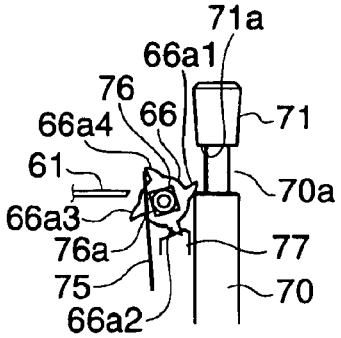
Figure 6B:
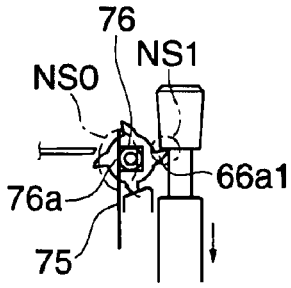

First, as shown in FIG. 6A, in the initial position, the driving nail 66*a*1 of the rotary pick 66 slides into the channel-shaped stepped space 70*a* so that the driving nail 66*a*1 is hooked by the plunger 70. In this state, the driving nail 66*a*2 is fitted in the groove 77*a* of the grooved braking member 77.

Figure 6C:
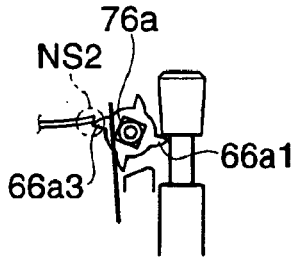
Figure 6D:
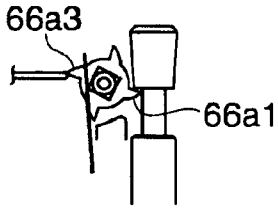

Next, when the solenoid coil 68 is energized, the plunger 70 (and the hook part 71) starts moving downward, then the engaging part 71*a* is brought into contact with the driving nail 66*a*1 (FIG. 6B) to rotate the rotary pick 66 clockwise, and the driving nail 66*a*3 located symmetrically to the driving nail 66*a*1 engaged with the engaging part 71*a* plucks the radially outer end of the reed 61, thereby generating sound (FIGS. 6C and 6D). On this occasion, the direction of a rotative driving force applied to the rotary pick 66 due to a reaction force of the cam spring 75 through the cam parts 76 temporarily becomes counterclockwise. However, as a clockwise rotative driving force applied by the engaging part 71*a* surpasses the above counterclockwise rotative driving force, the rotary pick 66 never rotates counterclockwise.

Figure 6E:
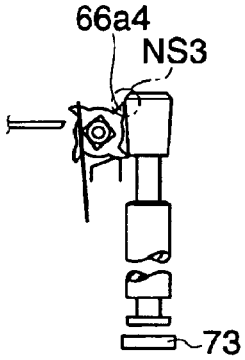
Figure 6F:
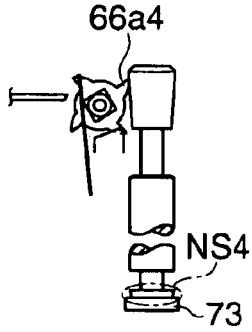

As the plunger 70 further moves downward, the driving nail 66*a*3 which has plucked the reed 61 departs from the reed 61, and thereafter the direction of the rotative driving force applied to the rotary pick 66 due to the reaction force of the cam spring 75 becomes clockwise again. The driving nail 66*a*4 of the rotary pick 66 comes into contact with the hook part 71 to stop the rotation of the rotary pick 66 (FIG. 6E). As the plunger 70 further moves downward, it comes into contact with the lower cushion part 73 and reaches a descending end position as a bottom dead point, namely, a forward stroke end position (FIG. 6F).

Figure 6G:
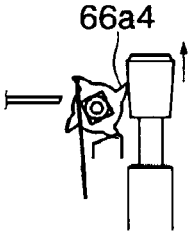
Figure 6H:
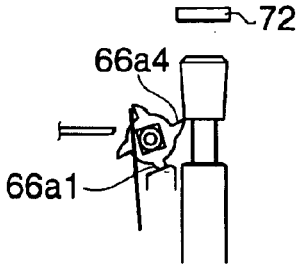

Then, the solenoid coil 68 is deenergized so that the plunger 70 starts moving upward due to a reaction force of the plunger spring 69. However, since the clockwise rotative driving force is still applied to the rotary pick 66 by the cam spring 75, the rotary pick 66 does not rotate counterclockwise even when the plunger 70 moves upward (FIG. 6G).

Figure 6I:
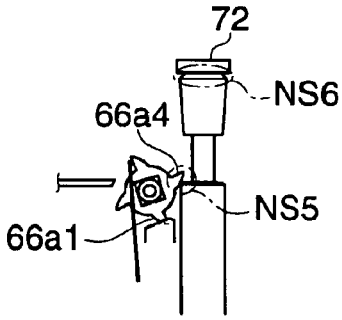

When the plunger 70 further moves upward and returns to a position in the vicinity of the initial position such that the channel-shaped stepped space 70*a* comes to face the driving nail 66*a*4 of the rotary pick 66 (FIG. 6H), the rotary pick 66 rotates clockwise by the clockwise rotative driving force of the cam spring 75 so that the driving nail 66*a*4 slides into the channel-shaped stepped space 70*a* again and engages with the plunger 70. Almost at the same time, the hook part 71 comes into contact with the upper cushion part 72. Thus, the plunger 70 returns into the initial state (FIG. 6I). In this way, a sounding operation stroke for generating sound once by plucking the reed 61 is completed.

In the sounding operation stroke, a mechanical noise is generated in specific timing. For example, a mechanical noise is generated mainly by impact when the cam spring 75 comes into contact with the cam surface 76*a* of the cam part 76 (a generation point NS0 in FIG. 6B), when the engaging part 71*a* comes into contact with the driving nail 66*a*1 (a generation point NS1 in FIG. 6B), when the driving nail 66*a*3 comes into contact with the radially outer end of the reed 61 (a generation point NS2 in FIG. 6C), when the driving nail 66*a*4 comes into contact with the hook part 71 (a generation point NS3 in FIG. 6E), when the plunger 70 comes into contact with the lower cushion part 73 (a generation point NS4 in FIG. 6F), when the driving nail 66*a*4 slides into the channel-shaped stepped space 70*a* to be engaged with the plunger 70 (a generation point NS5 in FIG. 6I), and when the hook part 71 comes into contact with the upper cushion part 72 (a generation point NS6 in FIG. 6I).

In the present embodiment, however, mechanical noise is suppressed by the above described cushioning members, the grooved braking member 77, and so forth.

Specifically, first, for the generation point NS0, the cushioning action of the elastic sheet 79 weakens an impact that may occur when the cam spring 75 comes into contact with the cam surface 76*a*, thus reducing a contact mechanical noise. Further, for the generation point NS0, in the state shown in FIG. 6A, the driving nail 66*a*2 is engaged with the groove 77*a* of the grooved braking member 77, and hence a brake is put on the rotation of the rotary pick 66 by the driving nail 66*a*2 and the groove 77*a*, which are in sliding contact with each other. For this reason, the rotational speed of the rotary pick 66 has been decreased when the cam spring 75 and the cam surface 76*a* come into contact with each other, and thus the impact upon the contact between the cam spring 75 and the cam surface 76*a* is decreased. As a result, mechanical noise can be reduced as compared with the case where the grooved braking member 77 is not provided.

For the generation point NS3, the cushioning action of the cushioning member 71*b* (refer to FIG. 5A) weakens an impact that may occur when the driving nail 66*a*4 comes into contact with the hook part 71, thus reducing mechanical noise. Further, for the generation point NS3, after the driving nail 66*a*3 plucks the reed 61, the driving nail 66*a*1 engages with the groove 77*a* of the grooved braking member 77, so that the rotation of the rotary pick 66 is rapidly braked by the driving nail 66*a*1 and the groove 77*a* which are in sliding contact with each other (FIGS. 6D to 6E). Therefore, the rotational speed of the rotary pick 66 is decreased immediately before the driving nail 66*a*4 comes into contact with the hook part 71, and this reduces impact occurring upon contact between the driving nail 66*a*4 and the hook part 71. As a result, mechanical noise can be reduced as compared with the case where the grooved braking member 77 is not provided.

Further, for the generation point NS4, the elasticity of the lower cushioning part 73 absorbs an impact that may occur when the plunger 70 comes into contact with the lower cushioning part 73, thus reducing mechanical noise. Similarly, for the generation point NS6, the elasticity of the upper cushioning part 72 absorbs an impact that may occur when the hook part 71 comes into contact with the upper cushioning part 72, thus reducing mechanical noise.

Further, for the generation point NS5, when the driving nail 66*a*4 slides again into the channel-shaped stepped space 70*a* (FIGS. 6H to 6I), the driving nail 66*a*1 is still engaged with the groove 77*a* of the grooved braking member 77, and the rotation of the rotary pick 66 is braked by the driving nail 66*a*1 and the groove 77*a* which are in sliding contact with each other. For this reason, the rotational speed of the rotary pick 66 has been decreased at a time point the driving nail 66*a*4 is hooked by the plunger 70, and this weakens an impact that may occur when the driving nail 66*a*4 and the plunger 70 come into contact with each other. As a result, mechanical noise can be reduced as compared with the case where the grooved braking member 77 is not provided.

It should be noted that the cushioning member 71*b* (refer to FIG. 5A) may be extended up to the engaging part 71*a* (refer to FIG. 3) at the lower end of the hook part 71. With this alternative construction, at the generation point NS1, the cushioning action of the cushioning member 71*b* can reduce an impact that may occur when the engaging part 71*a* comes into contact with the driving nail 66*a*1. Further, it should be noted that the same cushioning member as the cushioning member 71*b* may be provided in a part of the plunger 70 on which the driving nail 66*a*4 is hooked (i.e. at a shoulder of the plunger 70 that defines the channel-shaped stepped space 70*a*). With this alternative construction, the cushioning action of the cushioning member further reduces mechanical noise generated by an impact that may occur at the generation point NS5.

At the generation points NS1 and NS6, mechanical noise may be also reduced by drivingly controlling each actuator CYL1 by pulse width modulation (PWM). Further, a PWM table may be used to drivingly control each actuator CYL1, and it is preferred that the PWM table is updated based on the detection results obtained by the drive detector CS. The details of such technique have been disclosed in Japanese Patent Application No. 2002-166856 filed by the assignee of the present application.

A description will now be given of the drive detector CS. In FIG. 5, reference characters "A to D" shown on the driving nails 66*a* denote positions of the driving nails 66*a* during an operation stroke. For example, reference character "A" indicates a position assumed by the driving nail 66*a* when the plunger 70 is moving upward (this position substantially corresponds to FIG. 6G). Reference character "B" indicates a position assumed by the driving nail 66*a* when the rotary pick 66 is waiting to be rotatively driven by the plunger 70 (this position substantially corresponds to FIGS. 6A to 6B). Reference character "C" indicates a position assumed by the driving nail 66*a* when the driving nail 66*a* starts plucking the reed 61 (this position substantially corresponds to FIG. 6C). Reference character "D" indicates a position assumed by the driving nail 66*a* when the plucking operation is completed (this position substantially corresponds to FIGS. 6D to 6E).

The drive detector CS is comprised of first and second contact leaves 52 and 53 each composed of an elastic conductor with an insulator 51 sandwiched therebetween. The first contact leaf 52 has a half part thereof extending upward to a position where it can come into contact with the driving nail 66*a*. The second contact leaf 53 has an upper part thereof formed with a contact part 53*a* in the form of a projection at a location facing the first contact leaf 52, and the contact part 53*a* serves as a contact make point.

When the driving nail 66*a* moves from the position "D" to the position "A" immediately after a plucking operation has been completed, the driving nail 66*a* presses the first contact leaf 52 without fail. Then, an upper part of the first contact leaf 52 is bent toward the second contact leaf 53 to cause the first contact leaf 52 to come into contact with the contact part 53*a* on the second contact leaf 53 to close the contacts. Thus, the completion of plucking of the reed 61 by the driving nail 66*a* is detected. A detection signal indicative of completion of plucking from the drive detector CS is transmitted to the CPU 11.

The above description referring to FIGS. 5 and 6 has been given only of the operation of part of the driving nails 66*a* taking particular rotational positions of the rotary pick 66 by way of example. However, the driving nails 66*a*1 to 66*a*4 sequentially perform similar operations.

According to the present embodiment, in the sounding operation stroke carried out by plucking the reed 61, an impact that may occur upon contact or engagement between component parts, e.g., between the rotary pick 66 and the hook part 71 or the plunger 70 or between the cam spring 75 and the cam surface 76*a*, or during a reciprocating motion of the plunger 70 is absorbed by the cushioning actions of the cushioning member 71*b*, the elastic sheet 79, and the upper and lower cushioning parts 72 and 73. Further, the rotational speed of the rotary pick 66 is decreased by the braking action of the grooved braking member 77 to weaken an impact that may occur upon contact or engagement between component parts. As a result, mechanical noise can be reduced by a simple construction.

Although in the present embodiment, the grooved braking member 77 is configured as a single body, the present invention is not limited to this, but the braking member 77 may be configured as separate bodies disposed at respective positions corresponding to the generation points NS0, NS1, and NS3 since the grooved braking member 77 contributes to reduction of mechanical noise at the generation points NS0, NS1, and NS3 by decreasing the rotational speed of the rotary pick 66.

Further, in place of the elastic sheet 79 or in addition to the elastic sheet 79, a cushioning member may be attached or bonded to each cam surface 76*a* of the cam part 76 so as to reduce mechanical noise at the generation point NS0.

A description will now be given of a second embodiment of the present invention.

The present embodiment is identical with the above described first embodiment except that the rotary pick 66 is provided with reed dampers.

Figure 7A:
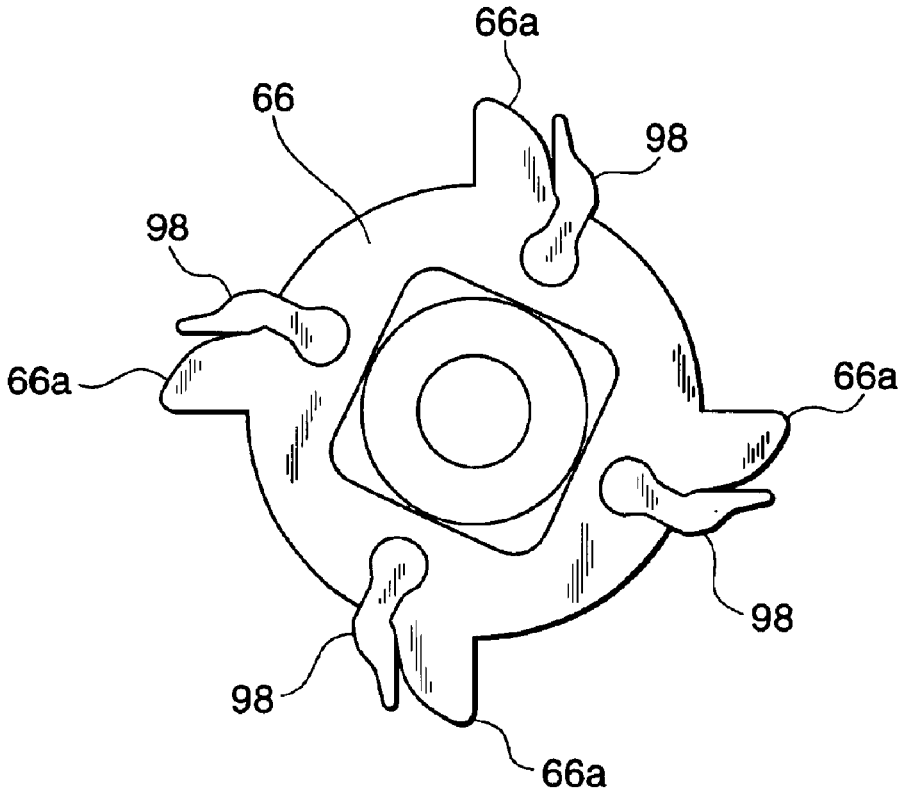
FIG. 7A is a side view showing the construction of a rotary pick in a performance apparatus according to a second embodiment of the present invention.
Figure 7B:
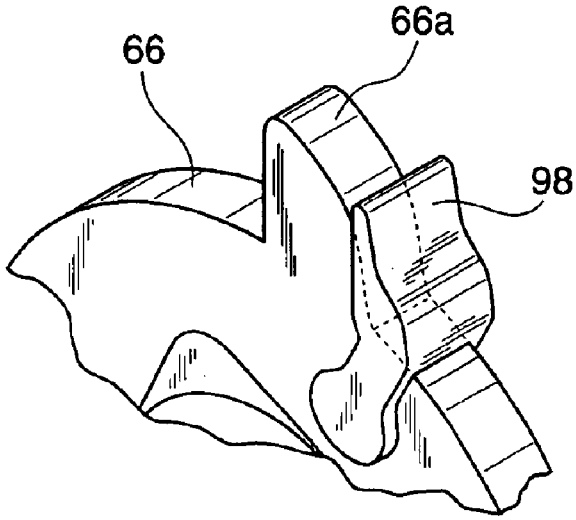
FIG. 7B is an enlarged fragmentary perspective view showing the appearance of the rotary pick in FIG. 7A.

FIG. 7A is a side view showing the construction of the rotary pick 66 in a performance apparatus according to the second embodiment, and FIG. 7B is a fragmentary perspective view showing the appearance of the rotary pick 66.

Reed dampers 98 are attached to the rotary pick 66 in association with the four driving nails 66*a*, respectively, and fixed to the rotary pick 6 by an adhesive or the like. The reed dampers 98 are each formed of an elastic material such as rubber, and are disposed in front of the respective driving nails 66*a* in the rotational direction of the rotary pick 66 and at a location where it comes into contact with the reed 61 immediately before the driving nail 66*a* plucks the reed 61. Each reed damper 98 is formed to be slightly shorter than the driving nail 66*a*, so that the driving nail 66*a* can directly pluck the reed 61 immediately after the reed damper 98 departs from the reed 61 with the rotation of the rotary pick 66.

Referring to FIG. 6 as well, the operation of the reed dampers 98 will be described. When the driving nail 66*a*3 is about to come into contact with the end of the reed 61 (FIGS. 6B to 6C), the reed damper 98 comes into contact with the reed 61 first. On this occasion, if the reed 61 is still vibrating due to the previous sounding operation, the cushioning action of the reed damper 98 quickly damps the vibration of the reed 61 without causing chattering. Immediately after that, the driving nail 66*a*3 comes into contact with the reed 61 to directly pluck the reed 61, but residual vibrations of the reed 61 have already been damped whereby chattering can be avoided. Therefore, mechanical noise caused by chattering can be reduced at the generation point NS2.

Further, when the driving nail 66*a*4 is about to come into contact with the hook part 71 (FIGS. 6D to 6E), the reed damper 98 comes into contact with the hook part 71 before the driving nail 66*a*4 comes into contact with the hook part 71. Therefore, at the generation point NS3, an impact that may occur upon contact is effectively weakened not only by the cushioning action of the cushioning member 71*b* and the braking action of the grooved braking member 77 as described above but also by the cushioning action of the reed damper 98.

According to the present embodiment, the reed damper 98 promptly damps residual vibrations of the reed 61 to reduce mechanical noise that may be generated by chattering when the reed 61 is plucked. Further, the reed damper 98 also serves as a cushion between the driving nail 66*a* and the hook part 71, which leads to effective reduction of mechanical noise without requiring a complicated construction.

Although in the present embodiment, the reed dampers 98 are provided in addition to the cushioning member 71*b* of the hook part 71, only the reed dampers 98 may be provided in place of the cushioning member 71*b* in terms of cushioning between the driving nail 66*a* and the hook part 71.

A description will now be given of a third embodiment of the present invention with reference to FIGS. 1, 6, 8, and 9A to 9C.

Figure 8:
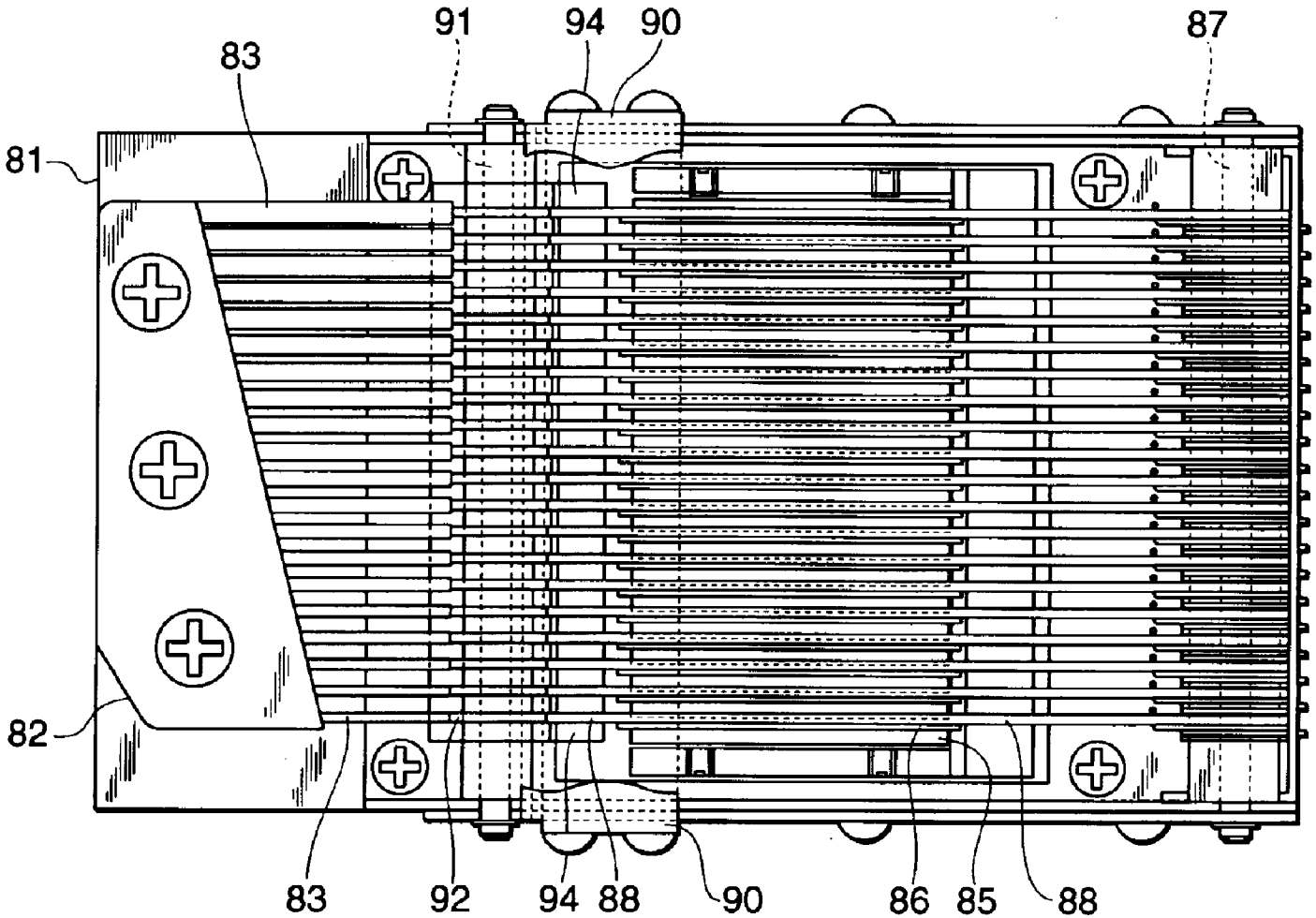
FIG. 8 is a top plan view showing a performance apparatus according to a third embodiment of the present invention.

FIG. 8 is a top plan view of a performance apparatus according to the third embodiment of the present invention.

Figure 9A:
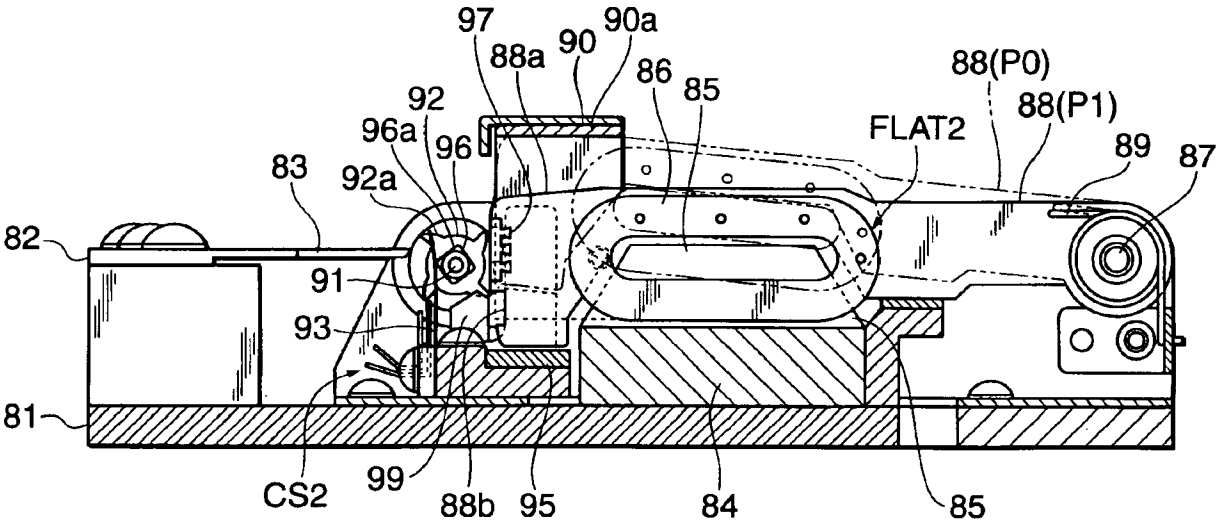
FIG. 9A is a sectional view showing the performance apparatus in FIG. 8.
Figure 9B:
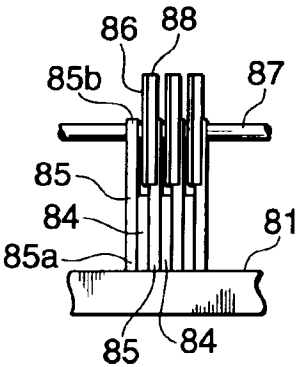
FIG. 9B is a front view showing essential parts of the performance apparatus as viewed from the left side in FIG. 9A.
Figure 9C:
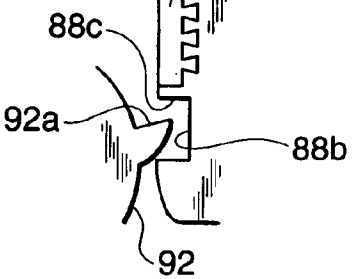
FIG. 9C is an enlarged fragmentary view showing a channel-shaped stepped space and a driving nail of a rotary pick of the performance apparatus.

FIG. 9A is a sectional view of this apparatus. FIG. 9B is a front view showing essential parts of the apparatus as viewed from the left side in FIG. 9A. FIG. 9C is an enlarged fragmentary view of a channel-shaped stepped space and a driving nail of a rotary pick.

In the present embodiment, the construction of the control section is basically the same as in the first embodiment shown in FIG. 1. However, an actuator FLAT2, which is implemented by a flat coil type, is employed in place of the actuator CYL1. Further, a drive detector CS2 is employed in place of the drive detector CS. The actuator FLAT2 is drivingly controlled by pulse width modulation (PWM) as is the case with the first embodiment.

As shown in FIG. 8, a plurality of reeds 83, which are a plurality of sounding elements of different sounding pitches, extend in the form of comb teeth from a base end member 82 fixed to a base plate 81. Further, rotary picks 92 are disposed in association with the respective reeds 83 and in the vicinity of the tips of the reeds 83.

The actuator FLAT2 is comprised of magnets 84, yokes 85, swing arms 88, flat coils 86, and so forth as shown in FIG. 9A. Each of the magnets 84, which is made of a rare earth magnet such as a neodymium-based magnet, and an associated one of the yokes 85 cooperate to constitute a magnetic field generator which serves to generate a force for driving an associated one of the swing arms 88.

Specifically, the magnets 84 are fixed to the base plate 81 and arranged thereon in association with the respective reeds 83 in a direction in which the reeds 83 are juxtaposed. Each yoke 85 is disposed between adjacent magnets 84 such that the magnets 84 and the yokes 85 are alternately arranged. Each yoke 85 has a lower end 85*a* thereof sandwiched between adjacent ones of the magnets 84 and has an upper end 85*b* thereof projecting upward, whereby a magnetic field is formed above the magnets 84 and between the upper ends 85*b* of adjacent yokes 85.

As shown in FIG. 9A, each swing arm 88 has a free end 88*a* thereof disposed to vertically swing about a swing shaft 87. Arranged in the vicinity of the swing shaft 87 of the swing arm 88 is a swing arm spring 89 which permanently urges the swing arm 88 clockwise as viewed in FIG. 9A. FIG. 9A shows a state in which the swing arm 88 (swing arm 88 (P1)) is being swung. In the initial state, the swing arm 88 is biased by the spring 89 such that the swing arm 88 is in contact with an upper limit stopper 90 (a position indicated by the swing arm 88 (P0)). A lower limit stopper 95 determines a position where the swing arm 88 stops to be swung. A lateral guide 94 is disposed between adjacent swing arms 88 (FIG. 8) to restrict the movement of the swing arms 88 in a lateral direction (the direction in which the reeds 83 are juxtaposed).

Each flat coil 86 is shaped in the form of a plate and mounted on a corresponding one of the swing arms 88. The flat coil 86 is disposed almost in parallel with the vertical direction as well as with the longitudinal direction of the reed 83. The flat coil 86 is located in the magnetic field formed between the upper ends 85*b* of the yokes 85, and when the flat coil 86 is energized, the corresponding swing arm 88 is swung downward according to Fleming's left-hand rule. When the flat coil 86 is deenergized, the corresponding flat arm 88 is urged by the spring 89 to return to the original initial position.

As is the case with the first embodiment, each rotary pick 92 has its outer peripheral surface formed integrally with a plurality of (e.g. four) driving nails 92*a*, a rectangular cam part 96 is fixedly mounted on opposite end faces of the rotary pick 92, and a cam spring 93 is disposed in the vicinity of the rotary pick 92. The swing arm 88 has the free end 88*a* formed integrally with a channel-shaped stepped space 88*b* which is similar to the channel-shaped stepped space 70*a* in the first embodiment. As shown in FIG. 9C, the channel-shaped stepped space 88*b* has the same function as the channel-shaped stepped space 70*a* in the first embodiment, and has an engaging part 88*c* that corresponds to the engaging part 71*a* of the hook part 71.

As is the case with the first embodiment, the driving nails 92*a* receive a driving force from the engaging part 88*c* of the channel-shaped stepped space 88*b*, whereby the rotary pick 92 rotates about a rotary shaft 91. The cam part 96 and the cam spring 93 serve to cause the rotary pick 92 to rotate substantially only in one direction (clockwise as viewed in FIG. 9A).

With the above described construction, in place of the reciprocating motion of the plungers 70 in the first embodiment, the swing arms 88 swing in the vertical direction. In the present embodiment, the relationship in operation between the channel-shaped stepped space 88*b* and the rotary pick 92 is the same as the relationship in operation between the channel-shaped stepped space 70*a* and the rotary pick 66 in the first embodiment, and the two parts 88 and 92 make successive changes in motion in the same manner as shown in FIG. 6.

Further, as shown in FIG. 9A, the drive detector CS2 is provided in the vicinity of the rotary pick 96. The drive detector CS2 is disposed below the tip of each reed 83 and in association with the reed 83. The construction and operation of the drive detector CS2 are identical with those of the drive detector CS in the first embodiment.

A cushioning part 90*a* attached or bonded to a lower surface of the upper limit stopper 90 and the lower limit stopper 95 are constructed in the same manner as the upper cushioning part 72 and the lower cushioning part 72, respectively, in the first embodiment, and they function as cushioning members to absorb an impact that may occur upon contact with the swing arm 88, thus reducing mechanical noise.

Further, as shown in FIG. 9A, below the rotary pick 92, a grooved braking member 99 constructed in the same manner as the grooved braking member 77 is fixedly provided on the base plate 81. The grooved braking member 99 is shared by all the rotary picks 92, and is provided with a groove, not shown, corresponding to the groove 77*a* and in association with each rotary pick 92. The grooved braking member 99 has the same function as the grooved braking member 77, braking the rotation of the rotary pick 92, thus reducing mechanical noise that may be generated upon contact between the cam spring 93 and a cam surface 96*a* of the cam part 96 and contact between the driving nail 92*a* of the rotary pick 92 and the swing arm 88.

Further, as shown in FIGS. 9A and 9C, a cushioning member 97 formed of an elastic material such as rubber is attached to an end of the swing arm 88. The cushioning member 97 has the same function as the cushioning member 71*b* in the first embodiment, thus reducing mechanical noise that may occur upon contact between the driving nail 92*a* of the rotary pick 92 and the swing arm 88.

Further, an elastic sheet, not shown, which has the same construction and function as the elastic sheet 79, is attached or bonded to a side of the cam spring 93, which faces the cam part 96.

According to the present embodiment, substantially the same effects as those of the first embodiment can be obtained in terms of mechanical noise reduction.

The reed dampers 98 shown in FIGS. 7A and 7B may also be applied to the third embodiment, and is expected to obtain substantially the same effects as those of the second embodiment.

In the above described first to third embodiments, the rotary picks having the driving nails as sounding element driving parts are illustrated as sounding element driving members, but the present invention is not limited to this. For example, if it is configured such that sounding element driving members such as rotary picks having sounding element driving parts that perform a sounding operation of coming into contact with sounding elements such as reeds are driven by actuators to cause the sounding elements to generate sound, a mechanical noise can be generated upon engagement between the sounding element driving members and the actuators and chattering of the sounding elements may occur, and hence a cushioning member and a braking member that decreases the moving speed of the sounding element driving members may be provided between these component parts to reduce mechanical noises occurring at all these components.

Further, in place of the construction in which the cushioning member 71*b* and the cushioning member 97 are provided in the hook part 71 and the swing arm 88 on the actuator side or in addition to the actuator slide, cushioning members similar to the cushioning members 71*b* and 97 may be provided on the rotary picks 66 and 92.

Further, although in the above described first to third embodiments, the reeds are illustrated as sounding elements, the present invention is not limited to this. The present invention is applicable to any other sounding elements that produce acoustic sound when acted upon by either physical or magnetic means, e.g. sounding elements such as "strings" or "sound boards" which generate sound when mechanically excited. These sounding elements include, for example, plate-like sounding elements made of metal, wood, or the like.

What is claimed is:

1. A performance apparatus comprising:

a plurality of sounding elements capable of generating sound;

at least one sounding element driving member;

at least one sounding element driving part provided on said sounding element driving member, for performing a sounding operation of coming into contact with any of said sounding elements to cause said sounding element to generate sound;

an actuator engageable with said sounding element driving member, for driving said sounding element driving member; and at least first cushioning member provided on at least one of said actuator and said sounding element driving member, for absorbing an impact occurring when said actuator comes into engagement with said sounding element driving member.

2. A performance apparatus according to claim 1, comprising at least one second cushioning member provided in proximity to said sounding element driving part of said sounding element driving member; and wherein said second cushioning member is disposed to come into contact with any of said sounding elements immediately before said sounding element driving part comes into contact with said sounding element, for forcibly damping residual vibrations of said sounding element; and said second cushioning member is further disposed to come into contact with said actuator when said actuator is engaged with said sounding element driving member, for absorbing an impact caused by engagement between said actuator and said sounding element driving member.

3. A performance apparatus according to claim 1, wherein said actuator is capable of making a reciprocating motion, for driving said sounding element driving member during a forward stroke of the reciprocating motion; and wherein the performance apparatus further comprises at least one upper limit stopper and at least one lower limit stopper that are disposed to come into contact with said actuator to determine an upper limit position and a lower limit position, respectively, of said actuator, said upper limit stopper and said lower limit stopper comprising at least one third cushioning member and at least one fourth cushioning member, respectively, for absorbing an impact occurring when said upper limit stopper and said lower limit stopper come into contact with said actuator.

4. A performance apparatus according to claim 1, wherein said sounding element driving member is capable of being rotatively driven, said sounding element driving part of said sounding element driving member being provided on said sounding element driving member in proximity to an outer periphery thereof.

5. A performance apparatus according to claim 4, wherein:

said actuator is capable of making a reciprocating motion, for engagement with said sounding element driving member during a forward stroke of the reciprocating motion to thereby rotate said sounding element driving member in a predetermined direction;

the performance apparatus further comprises at least one cam mechanism comprising at least one cam part having a plurality of cam surfaces and fixedly provided on said sounding element driving member, and at least one urging member that constantly urges said cam part;

said cam mechanism being disposed such that said urging member departs from and comes into contact with the cam surfaces of said cam part in response to rotation of said sounding element driving member, for applying a bias force to said sounding element driving member only in the predetermined direction immediately after a sounding operation; and the performance apparatus further comprises at least one fifth cushioning member provided on at least one of said urging member and the cam surfaces of said cam part of said cam mechanism, for absorbing an impact occurring when said urging member and each of the cam surfaces of said cam part come into contact with each other.

6. A performance apparatus according to claim 5, further comprising at least one second braking member provided in proximity to said sounding element driving member, said second braking member being engageable with said sounding element driving member at least before said urging member and each of the cam surfaces of said cam part of said cam mechanism come into contact with each other, for decreasing a speed of said sounding element driving member when said urging member and the cam surface of said cam part come into contact with each other.

7. A performance apparatus comprising:

a plurality of sounding elements capable of generating sound;

at least one sounding element driving member;

at least one sounding element driving part provided on said sounding element driving member, for performing a sounding operation of coming into contact with any of said sounding elements to cause said sounding element to generate sound;

an actuator engageable with said sounding element driving member, for driving said sounding element driving member;

a base part; and at least one first braking member fixedly provided on said base part in proximity to said sounding element driving member, said first braking member being engageable with said sounding element driving member, for suppressing a motion of said sounding element driving member by causing said sounding element driving part to slide therein to reduce mechanical noise of the sounding element driving member.

8. A performance apparatus according to claim 7, wherein said first braking member is disposed to engage with said sounding element driving member at least before said actuator and said sounding element driving member come into engagement with each other, for decreasing a speed of said sounding element driving member when said actuator and said sounding element driving member come into engagement with each other.

9. A performance apparatus according to claim 7, wherein said first braking member has a groove formed therein, and wherein a width of the groove is set to be slightly smaller than that of said sounding element driving part.

10. A performance apparatus according to claim 9, wherein said first braking member brakes the motion of said sounding element driving member in a manner such that said sounding element driving part is engaged with the groove slide therein.

* * * * *